US009444158B1

(12) United States Patent
Kao et al.

(10) Patent No.: US 9,444,158 B1
(45) Date of Patent: Sep. 13, 2016

(54) LINE CONCENTRATOR HAVING A BODY WITH AN ARM WITH A POSITION LIMITING PROTRUSION

(71) Applicant: GIGA-BYTE TECHNOLOGY CO., LTD., New Taipei (TW)

(72) Inventors: Yung-Shun Kao, New Taipei (TW); Ya-Han Chang, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/926,210

(22) Filed: Oct. 29, 2015

(30) Foreign Application Priority Data

Jun. 24, 2015 (TW) ..... 104120354 A

(51) Int. Cl.
*H01R 13/627* (2006.01)
*H01R 9/24* (2006.01)

(52) U.S. Cl.
CPC ..... *H01R 9/24* (2013.01); *H01R 13/6275* (2013.01)

(58) Field of Classification Search
CPC ..... H01R 13/506; H01R 13/627; H01R 13/6272; H01R 13/6271; H01R 13/6273; H01R 13/6275
USPC ..... 439/352–358
See application file for complete search history.

(56) References Cited

U.S. PATENT DOCUMENTS 5,147,226 A * 9/1992 Kile ..... H01R 12/7005 439/374
5,161,996 A * 11/1992 Locati ..... H01R 12/7011 439/374
5,186,645 A * 2/1993 Bixler ..... H01R 13/639 439/358
5,431,573 A * 7/1995 Endo ..... H01R 13/518 439/157
6,126,474 A * 10/2000 Doye ..... H01R 13/6275 439/350
7,416,433 B1 * 8/2008 Wu ..... G02B 6/4246 439/160
7,422,464 B2 9/2008 Lloyd et al.
7,727,018 B2 * 6/2010 Bright ..... H01R 13/65802 439/607.28
8,512,063 B2 * 8/2013 Fu ..... H01R 12/73 439/358

FOREIGN PATENT DOCUMENTS

TW M492560 U 12/2004
TW M317098 U 8/2007

* cited by examiner

*Primary Examiner* — Chandrika Prasad
(74) *Attorney, Agent, or Firm* — Birch, Stewart, Kolasch & Birch, LLP

(57) ABSTRACT

A line concentrator and a connector assembly with the line concentrator are provided. The connector assembly includes a plurality of signal cables and a line concentrator, the line concentrator includes a body and an arm. The body includes a plurality of sidewalls connected to each other and a bottom plate connected to the sidewalls. An accommodating cavity is surrounded by the sidewalls. The bottom plate includes a plurality of holes connected through the accommodating cavity. The arm protrudes from a top of one of the sidewalls of the body and extends along a direction away from the bottom plate. The arm includes a position limiting protrusion.

23 Claims, 9 Drawing Sheets

LINE CONCENTRATOR HAVING A BODY WITH AN ARM WITH A POSITION LIMITING PROTRUSION

CROSS-REFERENCE TO RELATED APPLICATION

This non-provisional application claims priority under 35 U.S.C. §119(a) on Patent Application No. 104120354, filed in Taiwan on Jun. 24, 2015, the entirety of which is incorporated herein by reference.

BACKGROUND OF THE INVENTION

1. Field of the Invention

The present invention relates to a line concentrator and a connector assembly with the line concentrator, and particularly, to a line concentrator which does not have conductive pins.

2. Description of Related Art

In a computer such as a desktop computer, there are several elements on the front panel of the computer case, such as a power switch, power LED, a reboot button, a speaker socket, etc. In the computer case, these elements are connected to the corresponding connector on the motherboard via the respective signal cables. Hence, the elements on the front panel are connected to the corresponding connector on the motherboard via a plurality of signal cables.

In the process of assembling a computer, because the space inside of the case is limited, the assembly sequence is, first, fixing the motherboard inside the case, and inserting the connectors of the signal cables one by one into specific locations in the corresponding connector on the motherboard. However, it is difficult and inefficient to insert the connectors of the signal cables to connect to the specific pins inside the connector on the motherboard.

SUMMARY OF THE INVENTION

Accordingly, it is an object of the present invention to provide a line concentrator or a connector assembly with a line concentrator to facilitate connecting the signal cables to the motherboard.

To achieve the above-mentioned object, according to a first aspect of the present invention, a line concentrator comprises: a body, comprising a plurality pairs of sidewalls connected to each other and a bottom plate connected to the sidewalls, wherein the sidewalls of each pair are opposite to each other, the sidewalls surround and define an accommodating cavity, and the bottom plate comprises a plurality of holes communicated with the accommodating cavity; and at least one arm, protruding from one of the sidewalls of one the pairs and extending along a direction away from the bottom plate, wherein the at least one arm protrudes over the sidewalls and comprises at least one position limiting protrusion, and the at least one position limiting protrusion protrudes toward the opposite one of the sidewalls of one of the pairs and is located directly above the accommodating cavity.

According to a second aspect of the present invention, a connector assembly comprises: a line concentrator, comprising: a body, comprising a plurality pairs of sidewalls connected to each other and a bottom plate connected to the sidewalls, wherein the sidewalls of each pair are opposite to each other, the sidewalls surround and define an accommodating cavity, and the bottom plate comprises a plurality of holes communicated with the accommodating cavity; at least one arm, protruding from one of the sidewalls of one of the pairs and extending along a direction away from the bottom plate, wherein the at least one arm protrudes over the sidewalls and comprises at least one position limiting protrusion, and the at least one position limiting protrusion protrudes toward the opposite one of the sidewalls of one of the pairs and is located directly above the accommodating cavity; and a position limiting rib, protruding from an inner surface of one of the sidewalls of the body and extending in the direction away from the bottom plate, wherein a top of the position limiting rib is below a top of the one of the sidewalls; and a plurality of signal cables, respectively disposed into the accommodating cavity, and each of the signal cables including a connector and a cable connected to the connector, wherein one of the signal cables that is engaged with the line concentrator when the at least one position limiting protrusion abuts against a top of the connector of the one of the signal cables, a lateral sidewall of the connector is in contact with the position limiting rib, and an acute angle is formed by the lateral sidewall of the connector and the position limiting rib.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DESCRIPTION OF THE EMBODIMENTS

Figure 1:
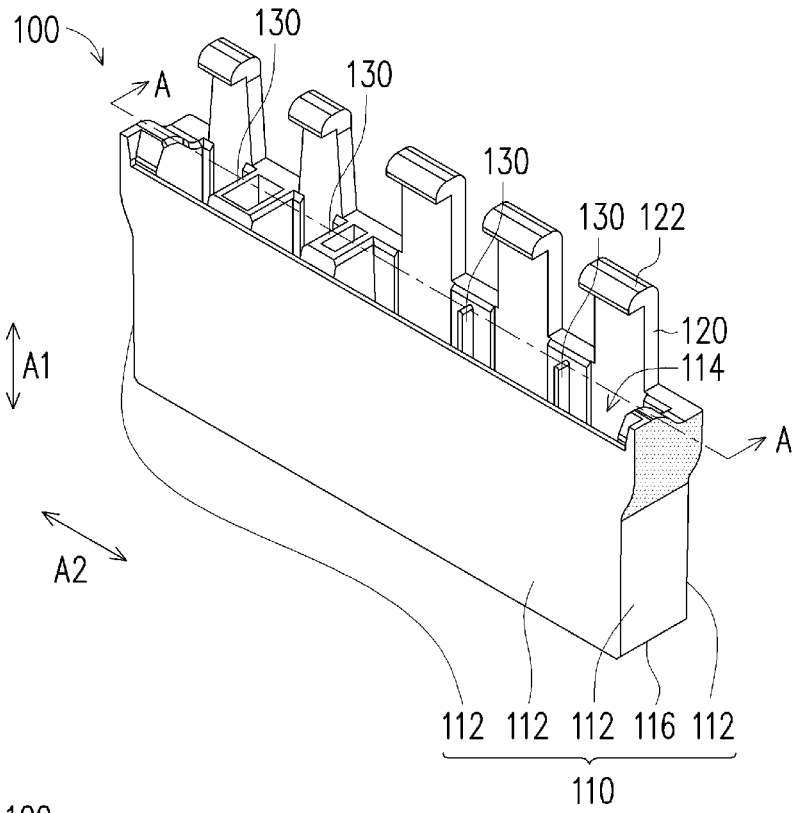
FIGS. 1-5 are schematic views at different angles of a line concentrator according to one embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

Figure 15:
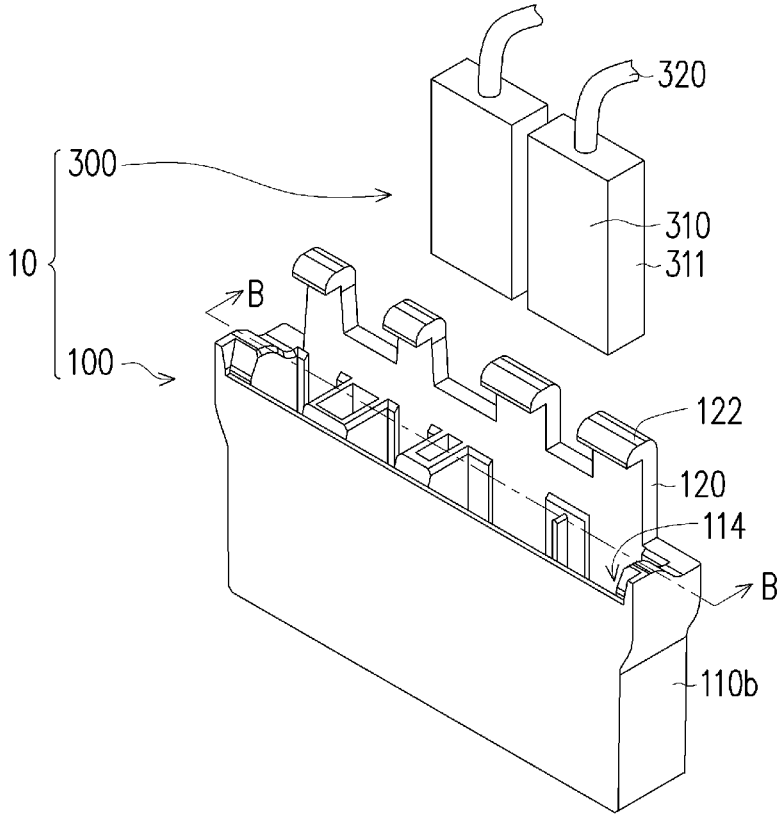
FIG. 15 is a schematic view of the line concentrator and a plurality of signal cables in assembled situation according to an embodiment of the present invention.

FIG. 15 is a schematic view of the line concentrator and a plurality of signal cables in assembled situation according to an embodiment of the present invention. As shown in FIG. 15, a connector assembly 10 includes a plurality of signal cables 300 and a line concentrator 100, and each of the signal cables 300 includes a signal cable connectors 310 and a cable 320 and is connected to a corresponding one elements such as the elements on the front panel of the computer case (e.g., a power switch, a power LED, a reboot button, a speaker socket, etc.). The line concentrator 100 is adapted to accommodate the signal cable connectors 310 therein, and the line concentrator 100 with the signal cable connectors 310 therein is inserted into at least a part of a front panel connector/header on the motherboard. Therefore, the signal cable connectors 310 can be easily organized in the line concentrator, so that the signal cable connectors 310 can be easily assembled with the connector on the motherboard, to prevent the user from connecting the signal cable connectors 310 to the wrong pins inside the connector on the motherboard, and to effectively increase the accuracy in assembling the signal cable connectors 310.

Figure 2:
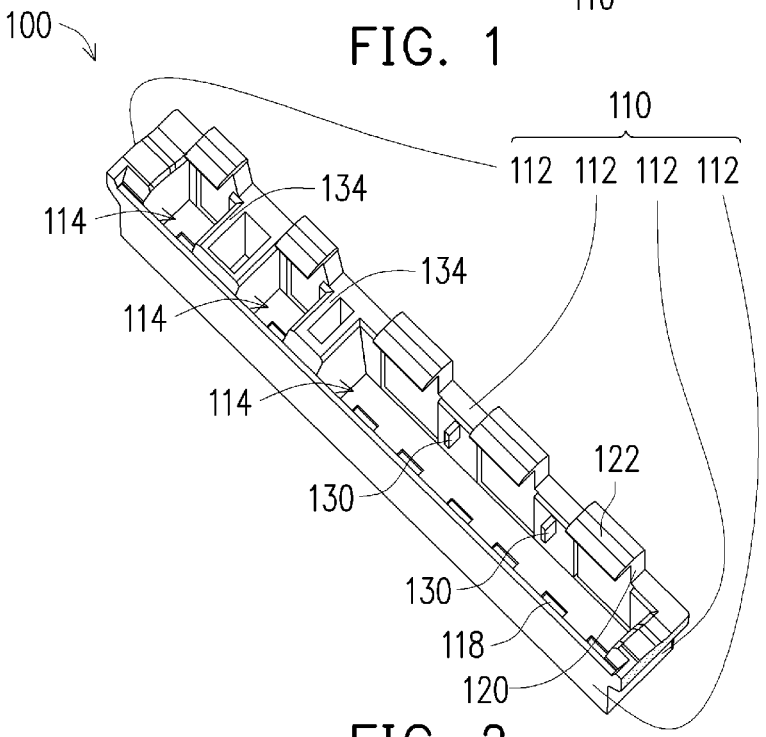
Figure 3:
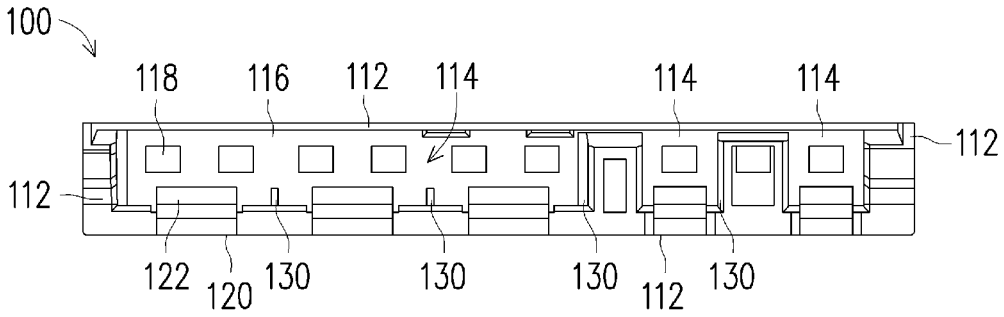

FIGS. 1-5 are schematic views at different angles of a line concentrator according to one embodiment of the present invention. FIG. 3 is a top view of FIG. 1. As embodied in FIGS. 1-5, the line concentrator 100 includes a body 110 and at least one arm 120. The body 110 includes a plurality pairs of sidewalls 112 connected to each other and a bottom plate 116 connected to the sidewalls 112. In the illustrated embodiment, the body 110 includes two pairs of sidewalls 112, and the sidewalls of each pair are opposite to each other. In an embodiment, the length of one of the pair of sidewalls 112 is larger than the other one of the pair of sidewalls, and the sidewalls 112 surround and define an accommodating cavity 114. The bottom plate 116 includes a plurality of holes 118 communicated with the accommodating cavity 114. In an embodiment, the material of the line concentrator 100 can be, but not limited to, plastic, rubber or other non-conductive materials.

The line concentrator 100 of the illustrated embodiment is adapted to accommodate the signal cable connectors 310, so that the signal cable connectors 310 can be accurately connected to the pins inside the front panel connector/header on the motherboard (not shown). Therefore, at least some of the holes 118 on the bottom plate 116 correspond to the position of the pins inside the front panel connector/header on the motherboard. When the line concentrator 100 with the signal cables 300 accommodated therein is inserted into the connector on the motherboard, the pins inside the connector on the motherboard are inserted into the holes 118, so as to be conductively coupled to the signal cable connectors 310. In an embodiment, the holes 118 on the bottom plate 116 correspond to the position of the pins inside the connector on the motherboard. Some of the holes 118 can be fabricated by, but not limited to, an injection molding method.

In an embodiment, there are two rows of pins inside the front panel connector/header on the motherboard. The line concentrator 100 is insert into the front panel connector/header on the motherboard, and one of two rows of pins are conductively coupled to the connectors of the signal cables 300 which are accommodated in the line concentrator 100. In the illustrated embodiment, the size of the line concentrator 100 is about one half of the size of the front panel connector/header on the motherboard, and one of two rows of pins of the front panel connector/header on the motherboard are correspondingly connected to the line concentrator 100.

In addition, in the illustrated embodiment, the arm 120 protrudes from a top of one of the sidewalls 112 of one the pairs of the body 110 and extends along a direction away from the bottom plate 116. In an embodiment, the arm 120 protrudes over the sidewalls 112 and includes a position limiting protrusion 122, and the position limiting protrusion 122 protrudes toward the opposite one of the sidewalls 112 of one of the pairs and is located directly above the accommodating cavity 114. When the connector 310 is positioned inside the accommodating cavity 114, a surface of the position limiting protrusion 122 facing the accommodating cavity 114 abuts against a top of the connector 310. Since the connector 310 can naturally move upwards, the connector 310 will be blocked by this surface of the position limiting protrusion 122 and engaged with the line concentrator 100, so that the connector 310 cannot be easily disengaged from the accommodating cavity 114.

In addition, if the user wants to remove the connector 310 from the accommodating cavity 114, the user can pull the arm 120 slightly, so that the arm 120 will move outwards and a space will be created above the accommodating cavity 114. Therefore, the connector can smoothly move upwards and disengage from the accommodating cavity 114.

Figure 6:
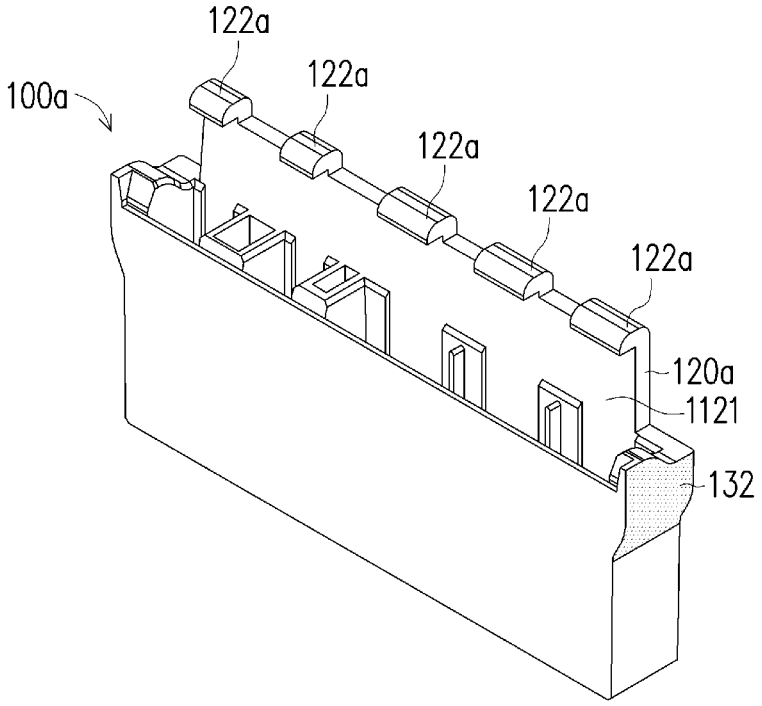
FIGS. 6 and 7 are schematic views of line concentrators according to other embodiments of the present invention.
Figure 7:
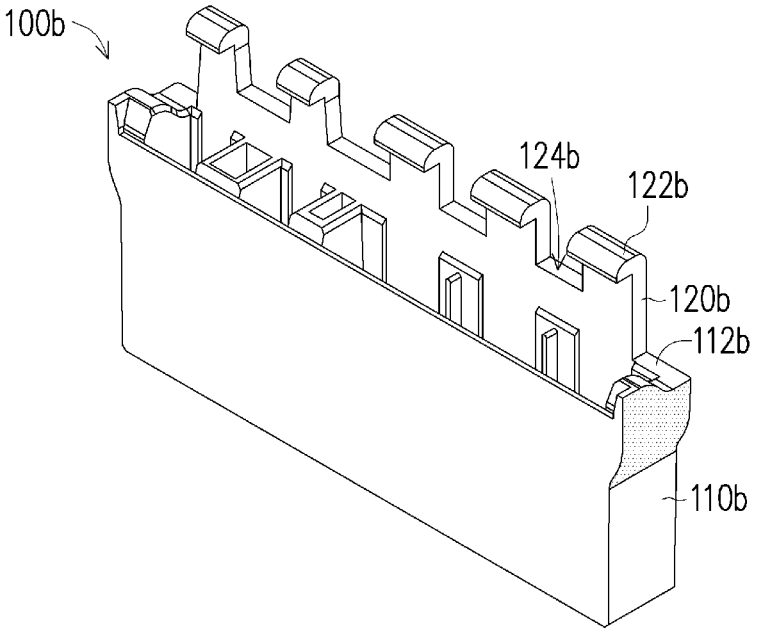

The form and the number of the arm 120 and the position limiting protrusion 122 are not limited as described in the illustrated embodiments. FIGS. 6 and 7 are schematic views of line concentrators according to other embodiments of the present invention. In the embodiments shown in FIGS. 6 and 7, the elements similar to or the same as the elements in the line concentrator 100 in FIG. 1 are presented by the similar or same reference numbers. As embodied in FIG. 6, the main difference is that the line concentrator 100 in FIG. 1 has a plurality of the arms 120, and each arm 120 only has one position limiting protrusion 122, while the line concentrator 100*a* in FIG. 6 includes only one arm 120*a*. The arm 120*a* has a sheet or plate form which has a larger dimension in the longitudinal direction and the lateral direction and has a smaller dimension in the thickness direction. In addition, the arm 120*a* includes a plurality of position limiting protrusions 122. As embodied in FIG. 7, the main difference between the line concentrator 100*b* in FIG. 7 and the line concentrator 100*a* in FIG. 6 is that the arm 120*b* includes at least one recess portion 124*b*, and the recess portion 124*b* is used to place the cable 320. To be more specific, the arm 120*b* in the embodiment illustrated in FIG. 7 includes four recess portions 124*b*, and each recess portion 124*b* is located between two immediately adjacent position limiting protrusions 122*b*. When the depth of the recess portion 124*b* is flush with the sidewalls 112*b* of the body 110*b*, the structure of the line concentrator 100*b* in FIG. 7 is similar to the structure of the line concentrator 100 in FIG. 1.

Therefore, when the signal cable connectors 310 is positioned inside the accommodating cavity 114, each of the cables 320 can be placed into the corresponding recess portion 124*b*, so that the cables 320 can be well positioned without entanglement.

Figure 8:
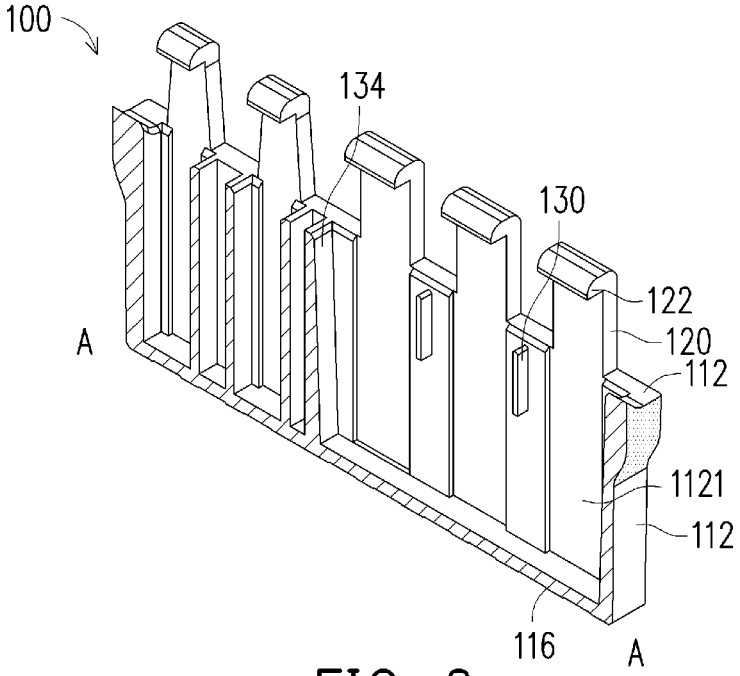
FIG. 8 is a schematic cross-sectional view along Line A-A' of the line concentrator in FIG. 1.

FIG. 8 shows a schematic cross-sectional view along Line A-A' in FIG. 1. As embodied in FIG. 8, each of the position limiting protrusions 122 protrudes from a top of the arm 120. In an embodiment, the position limiting protrusions 122 has a thickness of 0.5 mm starting from the inner surface 1121 of the one of the sidewalls 112 of the one of the pairs, and protruding along a direction of a normal line of the inner surface 1121 of the one of the sidewalls 112 of the one of the pairs. There are multiple factors to be considered when choosing the thickness of 0.5 mm of the position limiting protrusion 122, such as an elasticity coefficient of material of the arm 120, a force for unplugged the signal cable connectors 310 from the line concentrator 100, etc.

The material will affect the elasticity of the arm 120. If the elasticity coefficient of the material of the arm 120 is too large, the arm 120 may lose the elasticity or be broken easily after being used for some time; if the elasticity coefficient of the material of the arm 120 is too small, the arm 120 is difficult to pull. Therefore, in the above embodiments, the material of the arm 120 and the position limiting protrusion 122 are made from Acrylonitrile-butadine-styrene (ABS) to provide the desired elasticity coefficient. The required unplugged force may also affect the life span of the arm 120. If the user has to apply too much force in order to unplug the signal cable connectors 310 from the line concentrator 100, the cable 320 may be easily fractured from the signal cable connectors 310. In view of the above, the thickness of the position limiting protrusion 122 is selected to be 0.5 mm considering the material of the arm and the unplugged force, so that the signal cable connectors 310 not only can be fixed into the concentrator 100 conveniently, but also can be unplugged easily.

As embodied in FIGS. 1-8, the body 110 may further include a plurality of position limiting ribs 130 which protrude from one of the inner surfaces of the sidewalls 112, and the position limiting ribs 130 are disposed along the extending direction of the arm 120. In an embodiment, the position limiting rib 130 protrudes from the sidewall 112 on which the arms 120 are disposed. In an embodiment, each of the position limiting ribs 130 has a thickness of 0.5 mm staring from the inner surface 1121 of the one of the sidewalls 112 of the body 110, and protruding along a direction of a normal line of the inner surface 1121 of the one of the sidewalls 112 of the body 110. Therefore, the position limiting rib 130 is more suitable for guiding the signal cable connectors 310 along the first axis direction A1 (the vertical direction in FIG. 1), so as to be inserted into or removed from the accommodating cavity 114. In addition, the position limiting rib 130 can also prevent the connector 310 from moving along the second axis direction A2 (the horizontal direction in FIG. 1), so as to achieve the position limiting function.

As embodied in FIG. 8, the position limiting rib 130 protrudes from an inner surface 1121 of one of the sidewalls 112 of the body 110 and extends in the direction away from the bottom plate 116. In an embodiment, there are two forms of the position limiting rib 130. One of the two forms is that a top of the position limiting rib 130 is below the top of one of the sidewalls 112, which means that the length of the position limiting rib 130 is smaller than the height of the sidewall 112, and the position limiting rib 130 is disposed on the region that is close to the top of the sidewall 112. In the other form, the top of the position limiting rib 130 is as high as the top of one of the sidewalls 112, which means that the top of the position limiting rib 130 is flush with the top of the sidewalls 112. Both forms of the position limiting ribs 130 can provide position limiting function.

In other embodiments, the position limiting rib 130 can be disposed on the region that is close to the bottom of the sidewall 112, or can be disposed on the region that has an intermediate height of the sidewall 112. In addition, in an embodiment, the position limiting rib 130 protrudes starting at the inner surface 1121 of the one of the sidewalls 112 and ending at the inner surface 1121 of another one of the sidewalls 112 that is opposite to the one of the sidewalls 112, which means that the position limiting rib 130 can be directly connected to the opposite sidewall 112, and form a plurality of the accommodating cavities 114 that are segmented.

As embodied in FIGS. 2 and 8, the body 110 further includes a block 134 which extends along the extending direction of the arm 120 and on the left side in FIG. 2 or FIG. 8. The block 134 is disposed into the accommodating cavity 114, and a top of the block 134 is flush with the top of the sidewalls 112. The block 134 corresponds to an area of the bottom plate 116, and the area of the bottom plate 116 has no hole. The number of the block 134 can be one or more in different embodiments.

As embodied in FIG. 2 or 8, these blocks 134 are longer, wider, and higher, so as to have a bigger volume. The location and the width of the position limiting ribs 130 are disposed corresponding to the area which does not have pins of the front panel connector/header on the motherboard. Therefore, the signal cable connectors 310 are vertically guided and horizontally limited, and can also be used as structural reinforcement, so as to increase the total structural strength of the line concentrator 100.

Figure 5:
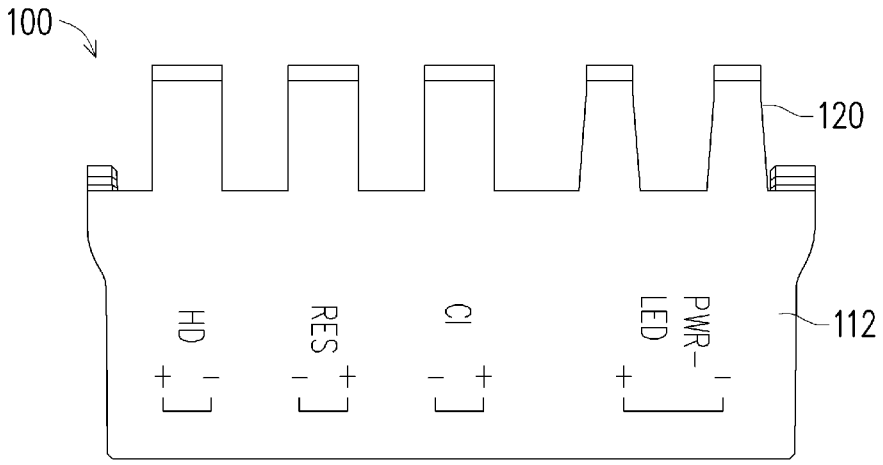

In addition, as embodied in FIGS. 5 and 6, an external surface of one of pair of the sidewalls 112, which is away from the bottom plate 116, has a skirt portion 132, In an embodiment, in the sidewalls 112 on the right and on the left in FIG. 5, the part away from the bottom plate 116 externally extends more than the part closer to the bottom plate 116, so that a size of an area surrounded by the sidewalls 112 away from the bottom plate is greater than a size of an area surrounded by the sidewalls 112 closer to the bottom plate 116. When the line concentrator 100 is correspondingly connected to the front panel connector/header, the size of sidewalls 112 away from the bottom plate 116 is approximately equal to or slightly greater than the external size of the front panel connector/header. Therefore, the user can conveniently grip the sidewalls 112 which externally extends, or the skirt portion 132 of the sidewalls of the line concentrator 100, when the user needs to remove the line concentrator 100, so as to reduce the risk that the user may inadvertently grip the external sides of the front panel connector/header which is located below the line concentrator 100. In order to facilitate removing the line concentrator 100, the external surface of the part away from the bottom plate 116 of the sidewalls 112 can have a rough surface (as the dotted area in FIG. 1), so as to increase friction between the fingers of the user and the sidewalls 112 of the line concentrator 100. In other embodiments, the skirt portion 132 of the sidewalls 112 has a texture structure or a plurality of ribs to increase friction between the fingers of the user and the sidewalls 112 of the line concentrator 100.

Figure 4:
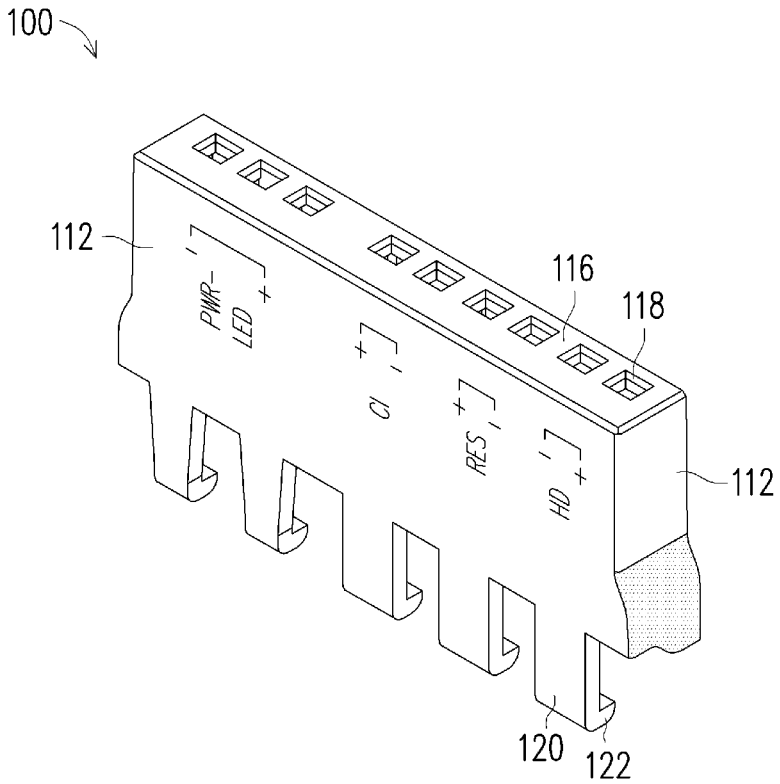

As embodied in FIG. 4 and FIG. 5, the external surface of one of the sidewalls 112 has marker symbols which serve as instructions/indication for the user to insert the connector 310. The marker symbols can be, but not limited to, words, images, bumps, pits, patterns, colors, etc.

In an embodiment, the body 110 and the arm 120 of the line concentrator 100 can be made of plastic, rubber or other non-conductive materials, and the line concentrator 100 does not include conductive elements, such as pins. Comparing to the conventional connecting method/structure, when the signal cable connectors 310 are connected to the front panel connector/header on the motherboard, the signal cable connectors 310 are directly and conductively coupled to the pins of the front panel connector/header without any additional conductive pins of an adapter in between for connecting. Therefore, the signal cable connectors 310 do not add any resistance.

Figure 9:
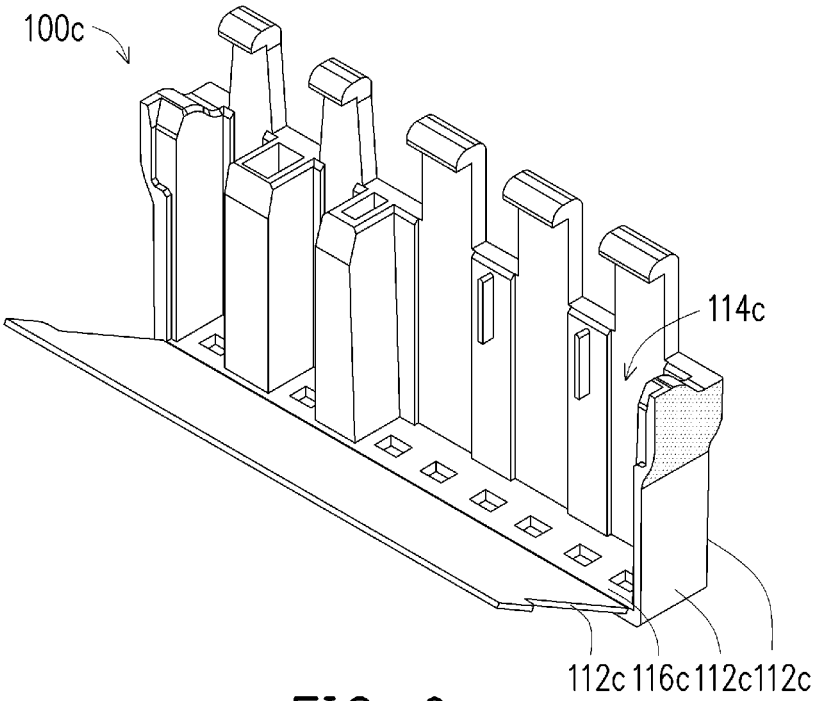
FIG. 9 is a schematic view of a line concentrator according to another embodiment of the present invention.

FIG. 9 is a schematic view of a line concentrator according to another embodiment of the present invention. In this embodiment, the elements similar to or the same as the elements in the line concentrator 100 in FIG. 1 are presented by the similar or same reference numbers. As embodied in FIG. 9, the main difference is that the sidewalls 112 of the body 110 of the line concentrator 100 in FIG. 1 are fixedly connected to each other. In the embodiment shown in FIG. 9, one of the sidewalls 112*c* of the body 110*c* is connected to the bottom plate 116*c* and is flippable, so that the one of the sidewalls 112*c* is able to be far away or closer to another one of the sidewalls 112*c* that is opposite to the one of the sidewalls 112*c*. In an embodiment, the signal cable connectors 310 can be inserted into the accommodating cavity 114 in a direction from the top to bottom or in a direction from the left to right after the flappable sidewall 112*c* is flipped to be opened, so as to provide different and optional inserting manners. The flappable sidewall 112*c* and the two sidewalls 112*c* at two sides are fixed to each other by the hooking or fastening structures.

FIGS. 10-13 are schematic views at different angles of a line concentrator according to another embodiment of the present invention. As embodied in FIGS. 10-13, the main difference is that the line concentrator 100 of the embodiment in FIG. 1 only corresponds to one of two rows of pins of the front panel connector/header, and the line concentrator 100 is only inserted into a local area of the front panel connector/header, while the line concentrator 200 of the embodiment in FIGS. 10-13 corresponds to two rows of pins of the front panel connector/header. As embodied in FIG. 1, the signal cable connectors 310, which are originally inserted into the front panel connector/header, need to be disposed on two separated line concentrators 100. These two line concentrators 100 can correspond to the two rows of the pins of the front panel connector/header respectively, and can be respectively inserted into the front panel connector/header.

As embodied in FIGS. 10-13, the line concentrator 200 includes the body 2101 and a second body 2102, and the second body 2102 that is in a side by side relation with and connected to the body 2101. The line concentrator 200 as embodied in FIGS. 10-13 corresponds to the two rows of the pins of the front panel connector/header. When the line concentrator 200 is inserted into the front panel connector/header, the two rows of the pins of the front panel connector/header are directly and conductively coupled to the signal cable connectors 310. In an embodiment, the body 2101 and the second body 2102 are integrally formed as a single piece. As embodied in FIG. 10, the second body 2102 has a plurality of sidewalls 212, and one of the sidewalls 212 of the second body 2102 is shared with the body 2101. To be more specific, the sidewalls 212 of the second body 2102 surround and define another accommodating cavity 214, and one of the sidewalls 212 of the second body 2102, which is a middle sidewall 212 of the line concentrator 200, separates the two rows of the accommodating cavities 214. In addition, the number and position of the two rows of the accommodating cavities 214, the position limiting ribs 230, and the arm 220 of the line concentrator 200 corresponding to different signal cable connectors 310 of the signal cables 300 are different.

Similarly, when the connector 310 is positioned inside the accommodating cavity 214, the surface of the position limiting protrusion 222 facing the accommodating cavity 214 abuts against the top of the connector 310. Since the connector 310 can naturally move upwards, the connector 310 will be blocked by this surface of the position limiting protrusion 222 and engaged with the line concentrator 200, so that the connector 310 cannot be easily disengaged from the accommodating cavity 114.

The line concentrator 200 is adapted to accommodate the signal cable connectors 310, and the line concentrator 200 with the signal cable connectors 310 therein together is inserted into the corresponding front panel connector/header on the motherboard. Therefore, the signal cable connectors 310 can be organized in the line concentrator 200, so as to easily assemble the signal cable connectors 310 with the connector on the motherboard, to prevent the user from connecting the signal cable connectors 310 to the wrong pins inside of the connector on the motherboard, and to effectively increase the accuracy in assembling the signal cables 300.

Figure 10:
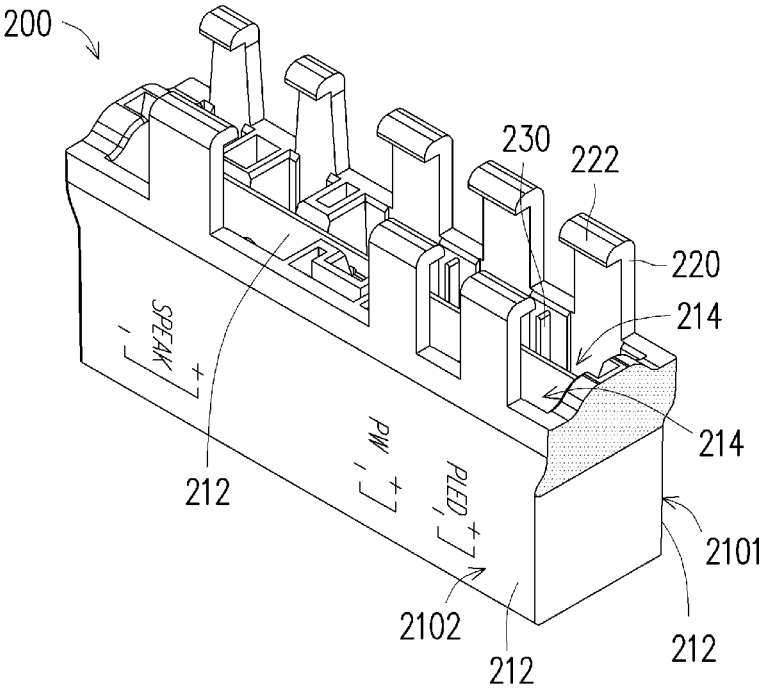
FIGS. 10-13 are schematic views at different angles of a line concentrator according to another embodiment of the present invention.
Figure 11:
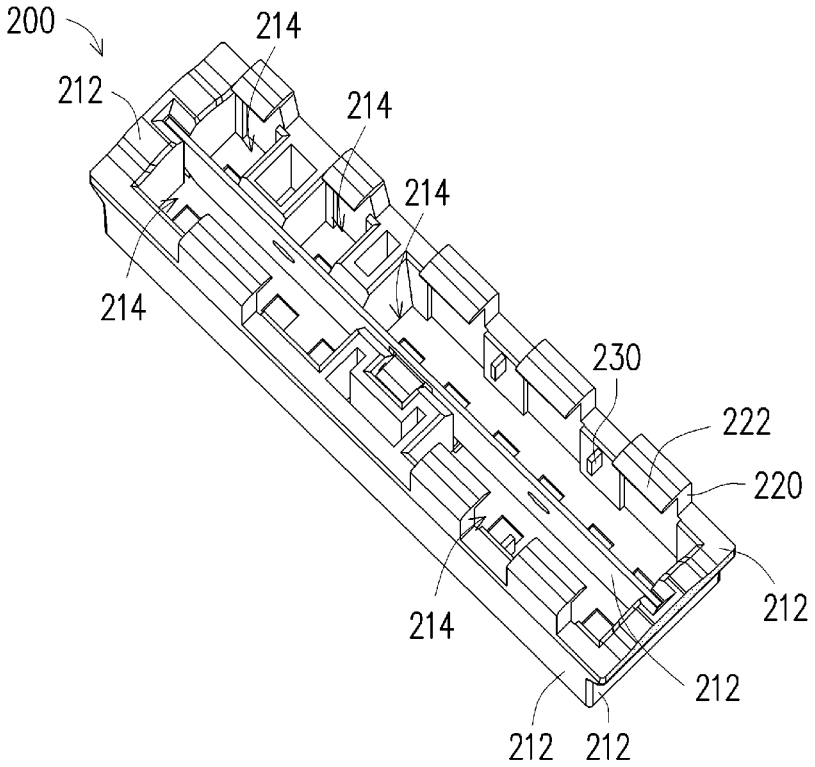
Figure 12:
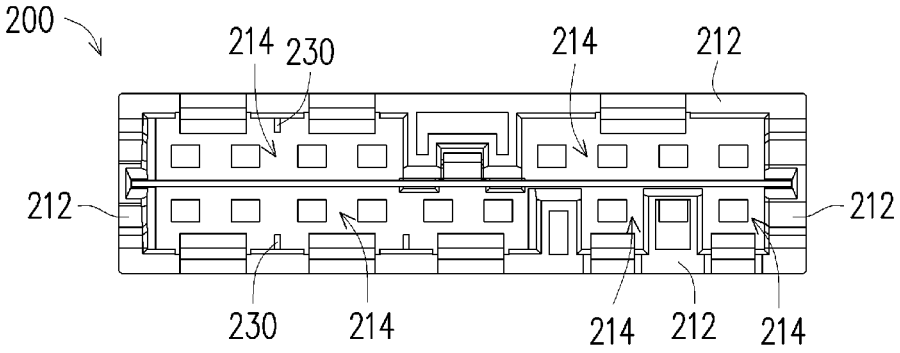
Figure 13:
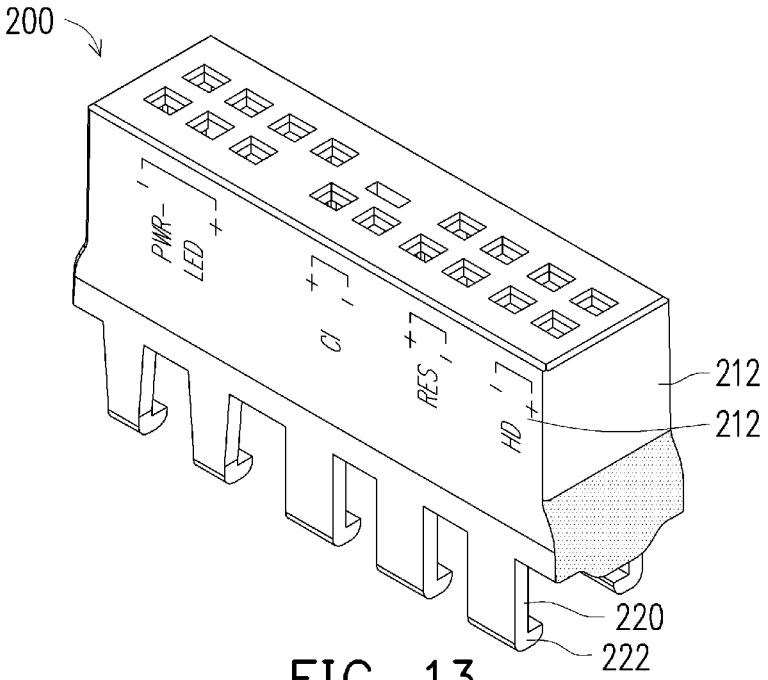
Figure 14:
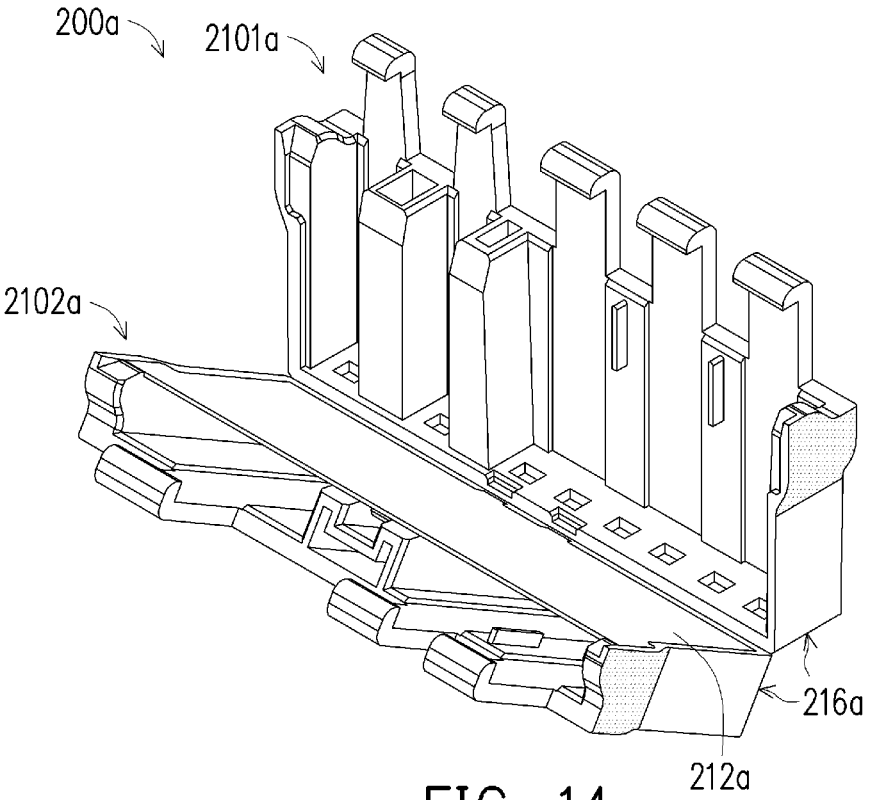
FIG. 14 is a schematic view of a line concentrator according to another embodiment of the present invention.

FIG. 14 is a schematic view of a line concentrator according to another embodiment of the invention. In FIG. 14, the elements similar to or the same as the elements in the line concentrator 200 in FIG. 10 are presented by the similar or same reference numbers. As embodied in FIG. 14, the main difference is that the body 2101 and the second body 2102 of the line concentrator 200 in FIG. 10 are fixedly connected to each other, while the body 2101*a* and the second body 2102*a* in FIG. 14 are connected and flippable with respect to each other. As embodied in FIG. 14, the body 2101*a* and the second body 2102*a* are connected and flippable with respect to each other, so that the second body 2102*a* is configured to relatively turn away from the body 2101*a* or turn toward the body 2101*a*. As embodied in FIG. 14, the body 2101*a* and the second body 2102*a* share a middle side wall 212*a*, the middle side wall 212*a* is fixed on the second body 2102*a*. Therefore, after the body 2101*a* and the second body 2102*a* are flipped to open, the body 2101*a* has four sidewalls 212*a*, and the second body 2102*a* has three sidewalls 212*a*.

In other embodiments, the middle sidewall 212*a* can also be flippable and connected to the bottom plate 216*a* and the middle side wall 212*a* is not fixed to any one of the sidewalls 212*a* of the body 2101*a* or the second body 2102*a*. In other words, the body 2101*a* and the second body 2102*a* both have three sidewalls 212*a*, and the middle sidewall 212*a* can actively flipped to be closer to the body 2101*a* or the second body 2102*a*. In other embodiments, the body 2101*a* and the second body 2102*a* both do not share the middle sidewall 212*a*, the body 2101*a* and the second body 2102*a* have four sidewalls 212*a* respectively.

Figure 16:
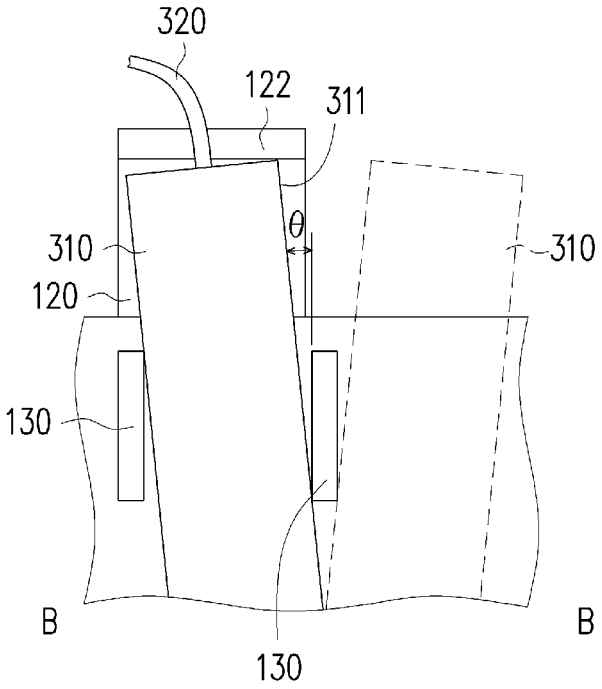
FIG. 16 is a schematic cross-sectional view of the combination of the line concentrator with the plurality of signal cables disposed inside according to an embodiment of the present invention.

FIG. 16 is a schematic cross-sectional view of the combination of the line concentrator with the plurality of signal cables disposed therein according to an embodiment. As embodied in FIG. 16, each of the signal cables 300 includes the signal cable connector 310 and the cable 320, and the cable 320 is connected to the signal cable connector 310. As embodied in FIG. 16, when the user inserts the signal cable connectors 310 into the line concentrator 100, each of the signal cable connectors 310 is respectively disposed into the corresponding accommodating cavity 114, and the signal cables 300 are engaged with the line concentrator 100 when the corresponding position limiting protrusions 122 respectively abut against the top of the signal cable connectors 310, so that the line concentrator 100 is combined with the signal cables 300 as a one piece of the connector assembly 10.

As embodied in FIG. 16, a lateral sidewall 311 of the signal cable connectors 310 is in contact with the position limiting rib 130 when the signal cable connectors 310 is disposed into the corresponding accommodating cavity 114, and an acute angle θ is formed by the lateral sidewall 311 of the signal cable connectors 310 and the position limiting rib 130. In an embodiment, a size of the signal cable connectors 310 is almost fit for matching a size of the corresponding accommodating cavity 114, and the extending length of the position limiting rib 130 is not as high as a full length of the sidewalls 112. Therefore, the signal cable connectors 310 disposed into the corresponding accommodating cavity 114 will be limited and oppressed by the position limiting rib 130, so that the connector 310 is inclined to the left side in FIG. 16 and the acute angle θ will be formed between the lateral sidewall 311 of the signal cable connectors 310 and the position limiting rib 130.

Figure 17:
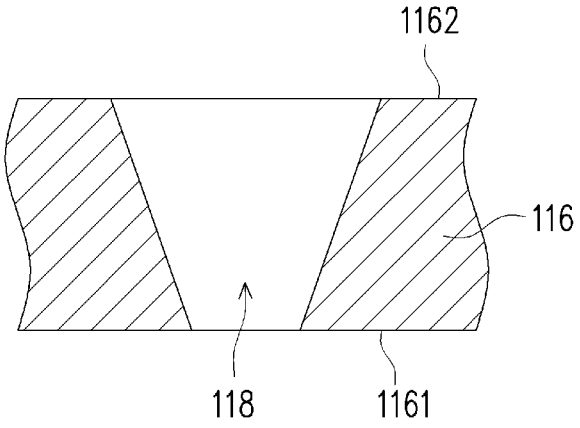
FIG. 17 is a schematic cross-sectional view of a hole of the bottom plate of the line concentrator according to an embodiment of the present invention.

Since each of the signal cable connectors 310 is inclined to dispose in the line concentrator 100, the signal cable connectors 310 do not correspond to the holes 118 on the bottom plate 116. In order to solve this problem, FIG. 17 is a schematic cross-sectional view of a hole of the bottom plate of the line concentrator according to an embodiment of the present invention. As embodied in FIG. 17, the bottom plate 116 further includes a first surface 1161 and a second surface 1162 that is opposite to each other, and each of the holes 118 is respectively perforated through the first surface 1161 and the second surface 1162, each of the holes 118 is defined by a surrounding sidewall, and a periphery of the surrounding sidewall at the second surface 1162 is larger than a periphery of the surrounding sidewall at the first surface 1161. In an embodiment, the first surface 1161 is a top surface of the bottom plate 116, and the second surface 1162 is a bottom surface of the bottom plate 116, and the surrounding sidewall is inclined from the first surface 1161 toward the second surface 1162.

From the above description of the invention, when the line concentrator 100 with the signal cables 300 therein together is inserted into the connector on the motherboard, the pins inside the connector on the motherboard are inserted into the holes 118 of the bottom plate 116. To be more specific, the pins inside the connector on the motherboard pass through the bottom plate 116 from the second surface 1162 to the first surface 1161, and the inclined surrounding sidewall would guide and direct the pins inside the connector on the motherboard, so that a positional deviation of the connector 310 can be compensated, and the pins inside the connector can be conductively coupled to the signal cable connectors 310.

As illustrated in the above embodiments, the connectors of the signal cables, such as the connectors of the signal cables of some elements on the front panel of the computer case, can be inserted into the accommodating cavities of the body of the line concentrator. When the connectors of the signal cables are inserted into the accommodating cavities, the position limiting protrusion of the arm is positioned above the connector of the signal cable so that the connector of the signal cable cannot be easily disengaged from the accommodating cavity. When using the line concentrator, the user inserts the connectors of the signal cables into the line concentrator, and then inserts the line concentrator together with the connectors of the signal cables therein together into the corresponding connector on the motherboard, so as to facilitate assembling the signal cables.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A line concentrator, comprising:

a body, comprising a plurality of pairs of sidewalls connected to each other and a bottom plate connected to the sidewalls, wherein the sidewalls of each pair are opposite to each other, the sidewalls surround and define an accommodating cavity, and the bottom plate comprises a plurality of holes communicating with the accommodating cavity; and at least one arm, protruding from one of the sidewalls of one of the pairs and extending along a direction away from the bottom plate, wherein the at least one arm protrudes over the sidewalls and comprises at least one position limiting protrusion, and the at least one position limiting protrusion protrudes toward the opposite one of the sidewalls of one of the pairs and is located directly above the accommodating cavity, wherein the at least one position limiting protrusion comprises a plurality of position limiting protrusions and a recess portion between two immediately adjacent position limiting protrusions.

2. The line concentrator as recited in claim 1, wherein the at least one arm comprises a plurality of arms.

3. The line concentrator as recited in claim 1, wherein the body further comprises a position limiting rib protruding from an inner surface of one of the sidewalls of the body and extending in the direction away from the bottom plate, and a top of the position limiting rib is below or as high as a top of the one of the sidewalls.

4. The line concentrator as recited in claim 3, wherein the position limiting rib is protruding starting at the inner surface of the one of the sidewalls and ending at the inner surface of another one of the sidewalls that is opposite to the one of the sidewalls.

5. The line concentrator as recited in claim 1, wherein a size of an area surrounded by the sidewalls away from the bottom plate is greater than a size of an area surrounded by the sidewalls closer the bottom plate.

6. The line concentrator as recited in claim 1, wherein an external surface of one of the sidewalls which is away from the bottom plate has a skirt portion.

7. The line concentrator as recited in claim 6, wherein the skirt portion has a texture structure or a plurality of ribs, or is a rough surface.

8. The line concentrator as recited in claim 1, wherein an external surface of one of the sidewalls has a marker symbol.

9. The line concentrator as recited in claim 1, wherein the one of the sidewalls of the body is connected to the bottom plate and is flippable away from or close to another one of the sidewalls that is opposite to the one of the sidewalls.

10. The line concentrator as recited in claim 1, wherein the line concentrator comprises a second body that is in a side by side relation with and connected to the body.

11. The line concentrator as recited in claim 10, wherein the body and the second body are integrally formed as a single piece, and the second body has a plurality of sidewalls, one of the sidewalls of the second body is shared with the body, thereby surrounding and defining another accommodating cavity.

12. The line concentrator as recited in claim 10, wherein the body and the second body are flippable with respect to each other, so that the second body is configured to relatively turn away from the body or turn toward the body.

13. The line concentrator as claimed as in claim 1, wherein the body further comprises a block disposed into the accommodating cavity, the block corresponds to an area of the bottom plate, and the area of the bottom plate has no hole.

14. The line concentrator as claimed as in claim 1, wherein the at least one position limiting protrusion has a thickness of 0.5 mm that starts from an inner surface of the one of the sidewalls of the one of the pairs, and along a direction of a normal line of the inner surface of the one of the sidewalls of the one of the pairs.

15. The line concentrator as claimed as in claim 1, wherein the bottom plate includes a first surface and a second surface opposite to the first surface, each of the holes is respectively perforated through the first surface and the second surface, each of the holes is defined by a surrounding sidewall, a periphery of the surrounding sidewall at the second surface is larger than a periphery of the surrounding sidewall at the first surface.

16. The line concentrator as claimed as in claim 15, wherein the first surface is a top surface of the bottom plate, and the second surface is a bottom surface of the bottom plate.

17. The line concentrator as claimed as in claim 16, wherein the surrounding sidewall is inclined from the first surface toward the second surface.

18. A connector assembly comprising:

a line concentrator, comprising:

a body, comprising a plurality pairs of sidewalls connected to each other and a bottom plate connected to the sidewalls, wherein the sidewalls of each pair are opposite to each other, the sidewalls surround and define an accommodating cavity, and the bottom plate comprises a plurality of holes communicated with the accommodating cavity;

at least one arm, protruding from one of the sidewalls of one of the pairs and extending along a direction away from the bottom plate, wherein the at least one arm protrudes over the sidewalls and comprises at least one position limiting protrusion, and the at least one position limiting protrusion protrudes toward the opposite one of the sidewalls of one of the pairs and is located directly above the accommodating cavity; and a position limiting rib, protruding from an inner surface of one of the sidewalls of the body and extending in the direction away from the bottom plate, wherein a top of the position limiting rib is below a top of the one of the sidewalls; and a plurality of signal cables, respectively disposed into the accommodating cavity, and each of the signal cables including a connector and a cable connected to the connector, wherein one of the signal cables that is engaged with the line concentrator when the at least one position limiting protrusion abuts against a top of the connector of the one of the signal cables, a lateral sidewall of the connector is in contact with the position limiting rib, and an acute angle is formed by the lateral sidewall of the connector and the position limiting rib.

19. The connector assembly as claimed as in claim 18, wherein the bottom plate includes a first surface and a second surface opposite to the first surface, each of the holes is respectively perforated through the first surface and the second surface, each of the holes is defined by a surrounding sidewall, a periphery of the surrounding sidewall at the second surface is larger than a periphery of the surrounding sidewall at the first surface.

20. The connector assembly as claimed as in claim 19, wherein the first surface is a top surface of the bottom plate, and the second surface is a bottom surface of the bottom plate.

21. The connector assembly as claimed as in claim 20, wherein the surrounding sidewall is inclined from the first surface toward the second surface.

22. The connector assembly as claimed as in claim 18, wherein the at least one position limiting protrusion has a thickness of 0.5 mm that starts from the inner surface of the one of the sidewalls of the one of the pairs, and along a direction of a normal line of the inner surface of the one of the sidewalls of the one of the pairs.

23. The connector assembly as claimed as in claim 18, wherein the position limiting rib has a thickness of 0.5 mm that starts from the inner surface of the one of the sidewalls of the body, and along a direction of a normal line of the inner surface of the one of the sidewalls of the body.

* * * * *